US006694761B2

(12) United States Patent
Cho et al.

(10) Patent No.: US 6,694,761 B2
(45) Date of Patent: Feb. 24, 2004

(54) COLD AIR SUPPLY APPARATUS OF REFRIGERATOR

(75) Inventors: Seong-Ho Cho, Seoul (KR); In-Seop Lee, Gyeonggi-Do (KR); In-Won Lee, Gyeonggi-Do (KR); Jae-Yong Sung, Seoul (KR); Jay-Ho Choi, Seoul (KR); Kwang-Hyup An, Seoul (KR); Jeong-Ho Lee, Gyeonggi-Do (KR); Young-Sok Nam, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/314,968

(22) Filed: Dec. 10, 2002

(65) Prior Publication Data

US 2004/0016247 A1 Jan. 29, 2004

(30) Foreign Application Priority Data

Jul. 25, 2002 (KR) ..... 10-2002-0043942

(51) Int. Cl.[7] ..... F25D 17/04
(52) U.S. Cl. ..... 62/186; 236/49.3; 62/187
(58) Field of Search ..... 62/186, 187, 404, 62/407; 236/49.3

(56) References Cited

U.S. PATENT DOCUMENTS 4,009,590 A * 3/1977 Webb et al. ..... 62/180
6,622,504 B2 * 9/2003 Lee et al. ..... 62/186

* cited by examiner

*Primary Examiner*—Marc Norman
(74) *Attorney, Agent, or Firm*—Greenblum & Bernstein, P.L.C.

(57) ABSTRACT

In a cold air supply apparatus of a refrigerator, by forming a cold air path for discharging cold air from the rear and side surfaces of a chilling chamber to distribute cold air from the rear and side surfaces of the chilling chamber selectively by using a damper, the apparatus includes a cold air discharge duct installed at the upper portion of a chilling chamber; a side cold air path connected with a certain side of the cold air discharge duct, formed at the side wall of the chilling chamber and guiding cold air to the side of the chilling chamber; and a damper installed on a certain side of the cold air discharge duct in order to open/close the cold air supply hole, the side cold air path and both the side cold air path and the cold air discharge duct selectively.

8 Claims, 6 Drawing Sheets

COLD AIR SUPPLY APPARATUS OF REFRIGERATOR

BACKGROUND OF THE INVENTION

1. Field of the Invention

The present invention relates to a cold air supply apparatus of a refrigerator, and in particular to a cold air supply apparatus of a refrigerator capable of distributing cold air selectively to the rear and the side surfaces of a chilling chamber.

2. Description of the Prior Art

In general, a refrigerator is partitioned into a freezing chamber for storing frozen food and a chilling chamber for storing cold food, and it has a refrigerating cycle for supplying cold air into the freezing chamber and the chilling chamber.

FIG. 1 is a perspective-sectional view illustrating the conventional refrigerator, and FIG. 2 is a sectional view illustrating a chilling chamber of the conventional refrigerator.

The conventional refrigerator consists of a main body 104 on which a pair of doors 102 open/closed in two ways installed on the front; a freezing chamber 106 placed on the left of the main body 104 and storing frozen food; a chilling chamber 108 partitioned from the freezing chamber 106 by a separation wall 110, placed on the right side of the main body 104; and a cold air supply apparatus supplied air cooled while passing the refrigerating cycle (not shown) to the freezing chamber 106 and the cooling chamber 108.

The cold air supply apparatus includes a blower 120 installed at the upper rear surface of the freezing chamber 106 and forcibly ventilating air cooled while passing the refrigerating cycle; a panel 128 installed at the front portion of the blower 120 and having plural cold air discharge holes 130 for discharging cold air inside the freezing chamber 106; a cold air supply path 132 formed at the upper portion of the separation wall 110 in order to make the cold air ventilated from the blower 120 flow into the chilling chamber 108; a cold air discharge duct 134 installed at the upper portion of the chilling chamber 108 and discharging the air supplied from the cold air supply path 132 into the chilling chamber 108; and a cold air inflow path 138 formed at the lower portion of the separation wall 110 and making the cold air finishing the cooling operation while circulating the chilling chamber 108 flow into the refrigerating cycle.

A damper 150 for opening/closing the cold air supply path 132 is installed on the cold air supply path 132 in order to pass/cut off cold air to the chilling chamber 108, and a temperature sensor 152 for sensing a temperature inside the chilling chamber 108 is installed inside the chilling chamber 108.

In the conventional refrigerator, when the refrigerating cycle is operated and the blower 120 is rotated, cold air cooled while passing the refrigerating cycle is respectively discharged into cold air discharge holes 130 of a panel 128 and the cold air supply path 132 by the ventilation pressure of the blower 120.

The cold air discharged through the cold air discharge holes 130 performs the cooling operation of frozen food stored in the freezing chamber 106 while circulating inside the freezing chamber 106.

And, the cold air supplied to the cold air supply path 132 flows into the cold air discharge duct 134 and is discharged into the chilling chamber 108 through cold air discharge holes 136 formed on the cold air discharge duct 134. The cold air discharged into the chilling chamber 108 performs the cooling operation of cold food stored in the chilling chamber 108 while circulating inside the chilling chamber 108, and the cold air finishing the cooling operation flows into the cold air inflow path 138 formed at the lower portion of the separation wall 110 and is cooled again while passing the refrigerating cycle.

Herein, the temperature sensor 152 detects a temperature inside the chilling chamber 108, when a temperature is not greater than a set temperature, the damper 150 is operated so as to close the cold air supply path 132, when a temperature is not less than a set temperature, the damper 150 is operated so as to open the cold air supply path 132 and perform the cold air supply.

However, in the conventional refrigerator, a cold air discharge duct is installed at the upper portion of a chilling chamber, cold air is supplied from the upper portion to the lower portion of the chilling chamber through cold air discharge holes formed on the cold air discharge duct, a temperature variation inside the chilling chamber is big according to a distance from the cold air discharge holes. And, because cold air is discharged only from the cold air discharge duct, when a high temperature load occurs due to foodstuff stored inside the chilling chamber, etc., lots of time is required for equalizing a temperature inside the chilling chamber, and freshness of the foodstuff stored in the chilling chamber may be lowered due to delay in cooling.

In order to solve the above-mentioned problems, plural cold air discharge holes can be formed inside the chilling chamber, and each cold air discharge hole is connected with each other in order to distribute cold air inside the chilling chamber evenly. However, in that case, because a cold par flow path is lengthened according to the increase of the number of cold air discharge holes, a discharge pressure of cold air is lowered, a cold air flow rate is decreased, and accordingly it is disadvantageous in the heat transmission aspect.

In addition, when a blower for providing a ventilation pressure is installed on each cold air discharge hole in order to prevent the cold air flow rate decrease, a structure of a refrigerator is complicated, a production cost is increased, and a power consumption and noise of the refrigerator are increased.

SUMMARY OF THE INVENTION

In order to solve the above-mentioned problems, it is an object of the present invention to provide a cold air supply apparatus of a refrigerator which is capable of preventing cold air discharge pressure lowering phenomenon and distributing cold air inside a chilling chamber evenly by forming cold air path so as to discharge cold air from the rear and side surfaces of the chilling chamber and distributing cold air to the rear and side surfaces of the chilling chamber selectively by using one damper without adding additional parts.

In order to achieve the above-mentioned object, a cold air supply apparatus of a refrigerator in accordance with the present invention includes a blower installed at the upper of a freezing chamber and forcibly ventilating air cooled while passing a refrigerating cycle; a cold air discharge duct installed at the upper portion of a chilling chamber so as to communicate with a cold air supply path formed at the upper portion of a separation wall partitioning the freezing chamber and the chilling chamber and discharging cold air from the upper portion of the chilling chamber; a side cold air path connected with a certain side of the cold air discharge duct, formed at the side wall of the chilling chamber and guiding cold air to the side surface of the chilling chamber; and a damper installed on a certain side of the cold air discharge duct in order to open/close the cold air supply hole, the side cold air path and both the side cold air path and the cold air discharge duct selectively.

The cold air discharge duct is installed on the rear upper portion of the chilling chamber so as to communicate with the cold air supply hole, a cold air discharge hole is respectively formed at the front and lower surfaces of the cold air discharge duct to discharge cold air inside the chilling chamber, and the side cold air path is connected to the bottom portion of the cold air discharge duct.

The damper is rotationally installed on the upper surface of the cold air discharge duct by a hinge shaft, and a damper driving unit for rotating the damper is connected to the hinge shaft.

The damper cuts off cold air supply to the chilling chamber by closing the cold air supply hole when it is placed on a first position according to the operation of the damper driving unit, cold air supply to the side cold air path is open and cold air supply to the cold air discharge duct is cut off when the damper is placed on a second position (II), and cold air supply to both the side cold air path and the cold air discharge duct is open when the damper is placed on a third position (III).

The damper driving unit is constructed as a stepping motor connected to the hinge shaft.

The cold air supply apparatus of the refrigerator further includes a cold air jet unit installed at the end of the side cold air path to jet cold air onto a load occurred region inside the chilling chamber intensively; and a control unit for controlling the cold air jet unit and the damper according to a temperature inside the chilling chamber.

The cold air jet unit includes a housing fixed so as to communicate with the cold air discharge hole formed at the end of the side cold air path; a nozzle rotatively supported by the housing and jetting cold air to a high-temperature load occurred region; a temperature sensor installed on the front of the nozzle, rotating with the nozzle and sensing the high-temperature load occurred region inside the chilling chamber; and a nozzle driving unit for rotating the nozzle.

The control unit separately controls the operation of the nozzle driving unit and the damper driving unit according to a signal applied from the temperature sensor.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter, the preferred embodiment of a cold air supply apparatus of a refrigerator in accordance with the present invention will be described with reference to accompanying drawings.

There can be plural embodiments of a cold air supply apparatus of a refrigerator in accordance with the present invention, hereinafter, the preferred embodiment will be described.

Figure 1:
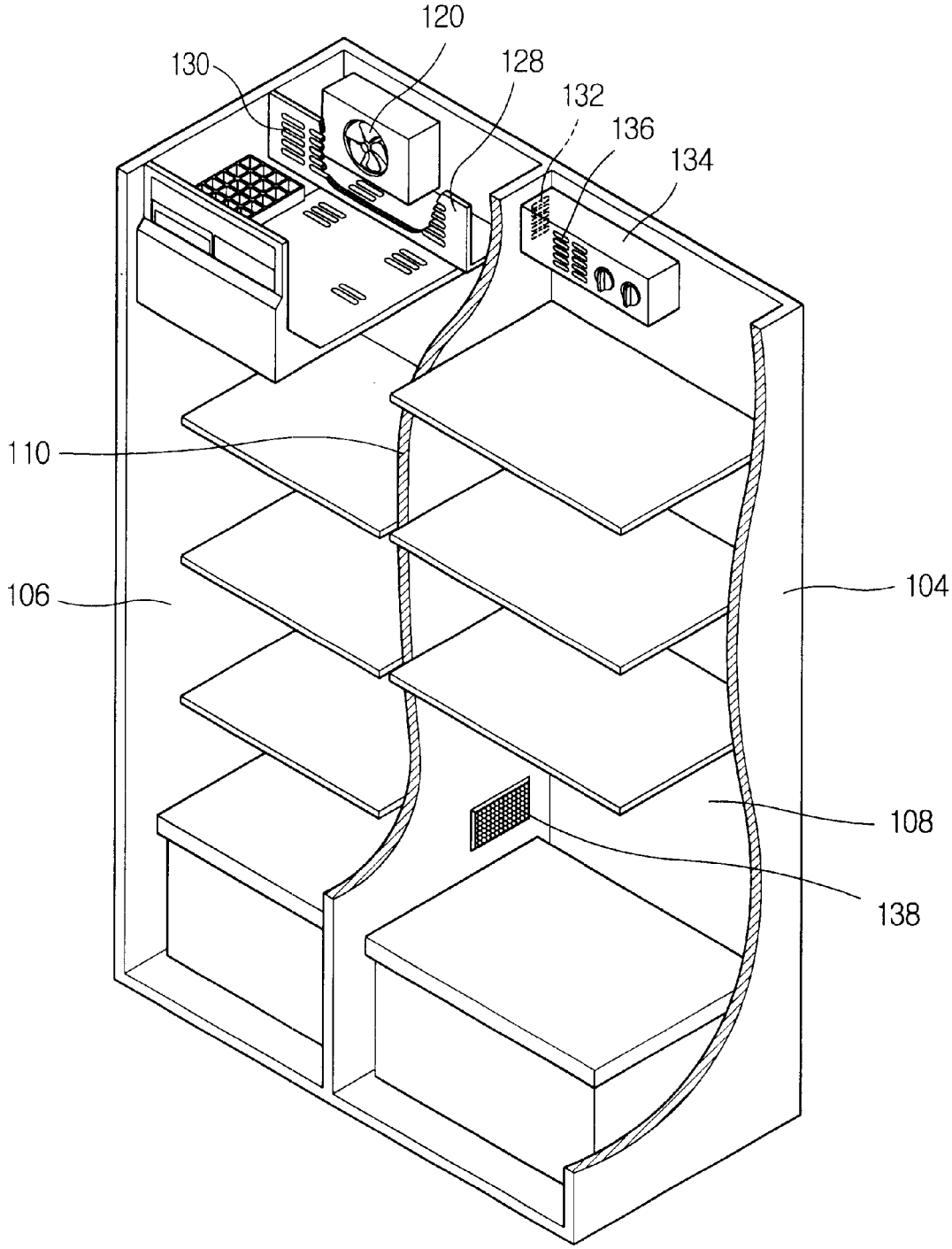
FIG. 1 CONVENTIONAL ART
FIG. 1 is a perspective-sectional view illustrating the conventional refrigerator.
Figure 2:
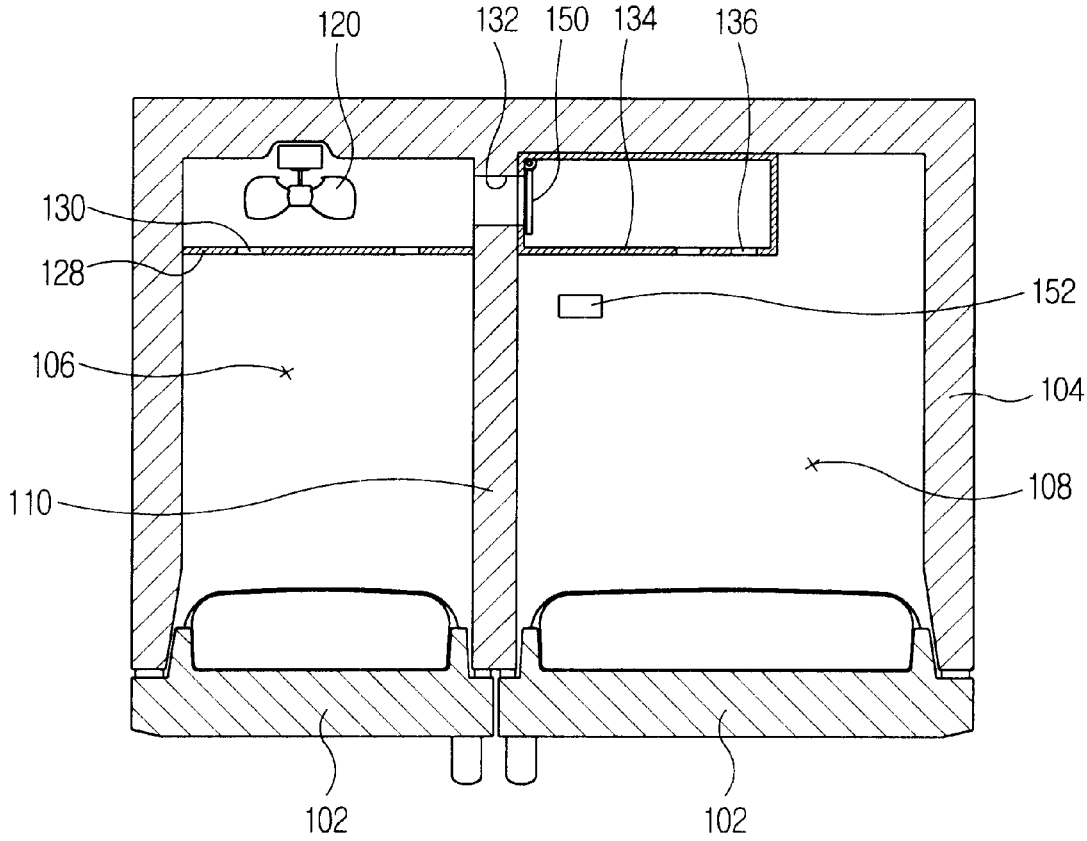
FIG.2 CONVENTIONAL ART
FIG. 2 is a sectional view illustrating a cold air supply apparatus of the refrigerator in accordance with the conventional art.
Figure 3:
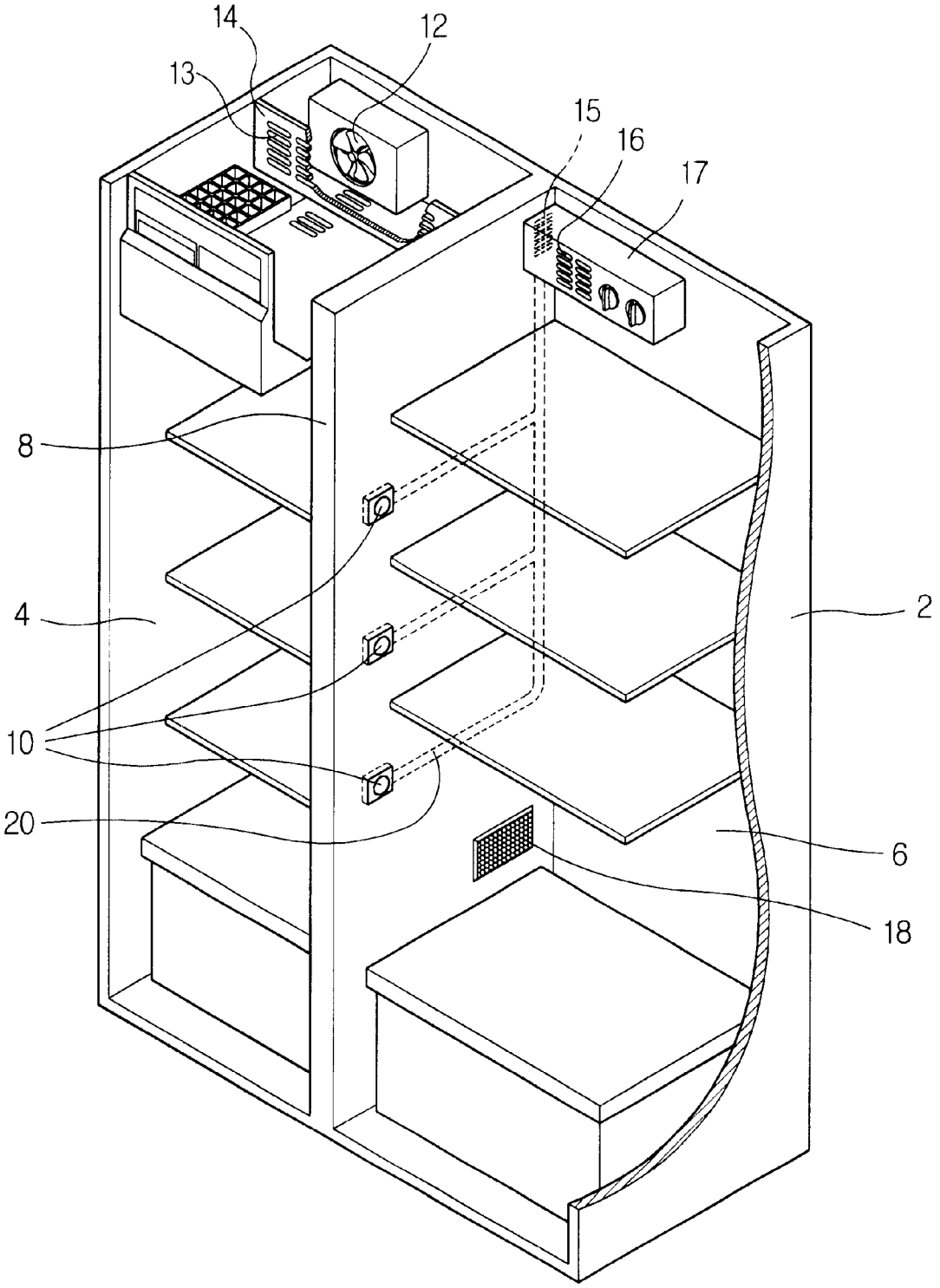
FIG. 3 is a perspective-sectional view illustrating a refrigerator in accordance with the present invention.
Figure 4:
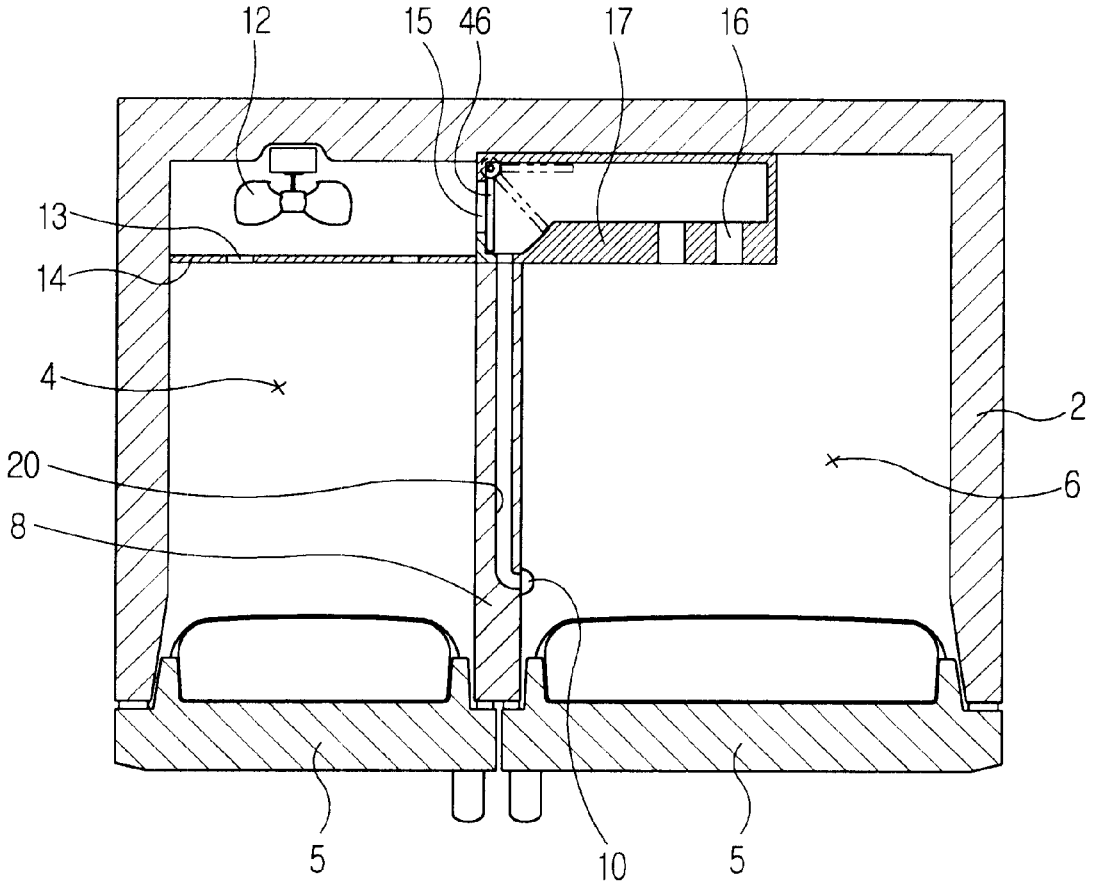
FIG. 4 is a sectional view illustrating a cold air supply apparatus of the refrigerator in accordance with the present invention.

FIG. 3 is a perspective-sectional view illustrating a refrigerator in accordance with the present invention, and FIG. 4 is a sectional view illustrating a cold air supply apparatus of the refrigerator in accordance with the present invention.

The refrigerator in accordance with the present invention includes a main body 2 on which a door 5 open/closed in two ways installed on the front; a freezing chamber 4 placed on the left or right of the main body 2 and storing frozen food; a chilling chamber 6 partitioned from the freezing chamber 4 by a separation wall 8 and storing cold food; a refrigerating cycle (not shown) installed at a certain side of the main body 2 and generating cold air; and a cold air supply apparatus for supplying air cooled while passing the refrigerating cycle to the freezing chamber 4 and the cooling chamber 6.

The cold air supply apparatus includes a blower 12 installed at the upper rear of the freezing chamber 4 and forcibly ventilating air cooled while passing the refrigerating cycle; a panel 14 installed at the front portion of the blower 12 and having plural discharge holes 13 for discharging cold air from the blower 12 into the freezing chamber 4; a cold air supply path 15 formed at the upper portion of the separation wall 8 in order to make the cold air ventilated from the blower 12 flow into the chilling chamber 6; a cold air discharge duct 17 installed at the upper portion of the chilling chamber 6 and having cold air discharge holes 16 for discharging cold air into the chilling chamber 6; and a side cold air path 20 connected with the cold air discharge duct 17, formed at the side wall of the chilling chamber 6 and guiding the cold air supplied through the cold air supply hole 15 to the side of the chilling chamber 6.

And, a cold air inflow path 18 is formed at the lower portion of the separation wall 8 to make the cold air finishing the cooling operation while circulating the chilling chamber 6 flow into the refrigerating cycle.

In the cold air discharge duct 17 having the cold air discharge hole 16 is respectively formed at the front surface and the lower surface thereof and communicated with the cold air supply hole 15. And, a connection path 26 connected to the side cold air path 20 is formed on the bottom portion of the cold air discharge duct 17.

The side cold air path 20 is connected to the cold air supply hole 15 and diverges from the side surface of the chilling chamber 6, and a cold air jet- unit 10 is respectively installed at each diverged end in order to jet cold air intensively onto a high-temperature load occurred region.

Figure 5:
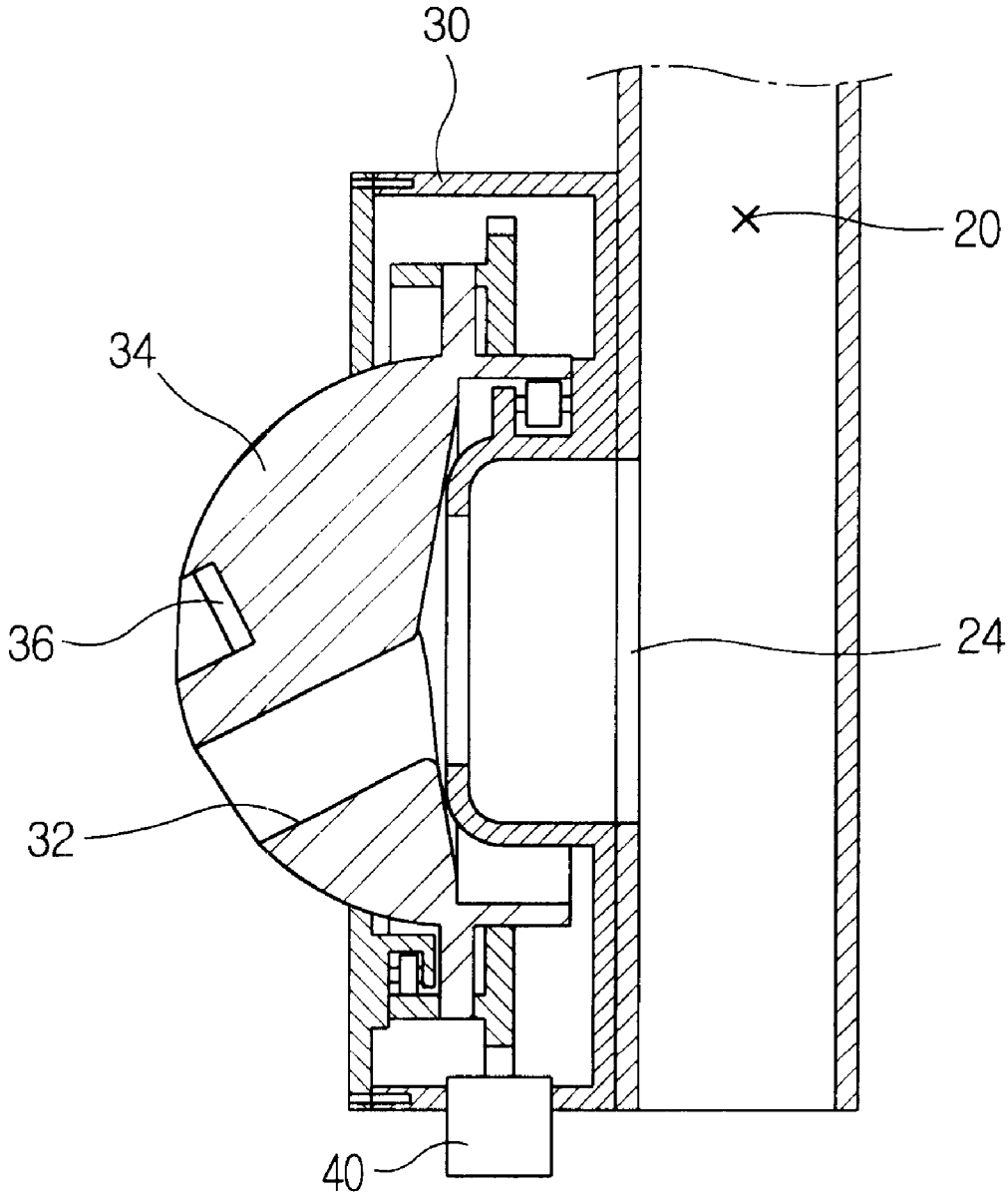
FIG. 5 is a sectional view illustrating a cold air jet unit of the refrigerator in accordance with the present invention.

As depicted in FIG. 5, the cold air jet unit 10 includes a housing 30 fixed so as to communicate with the cold air discharge hole 24 formed at the end of the side cold air path 20; a nozzle 34 rotatively supported by the housing 30 and jetting cold air to a high-temperature load occurred region; a temperature sensor 36 installed on the front of,the nozzle 34, rotating with the nozzle 34 and sensing the high-temperature load occurred region inside the chilling chamber 6; and a nozzle driving unit 40 for rotating the nozzle 34.

In the cold air jet unit 10, when the nozzle driving unit 40 is operated, the nozzle 34 is rotated. Herein, the temperature sensor 36 rotated together with the nozzle 34 senses a temperature inside the chilling chamber 6, when a high-temperature load occurs at a certain region, the nozzle 34 is rotated and discharges cold air onto the pertinent region intensively.

A damper 46 is installed on a certain side of the cold air discharge duct 17, namely, on a connect portion between the cold air supply hole 15 and the side cold air path 20 in order to pass/cut off cold air supply into the chilling chamber 6 or to perform the cold air supply to the side cold air path 20 and the cold air discharge duct 17 selectively by opening/closing the cold air supply hole 15.

Figure 6:
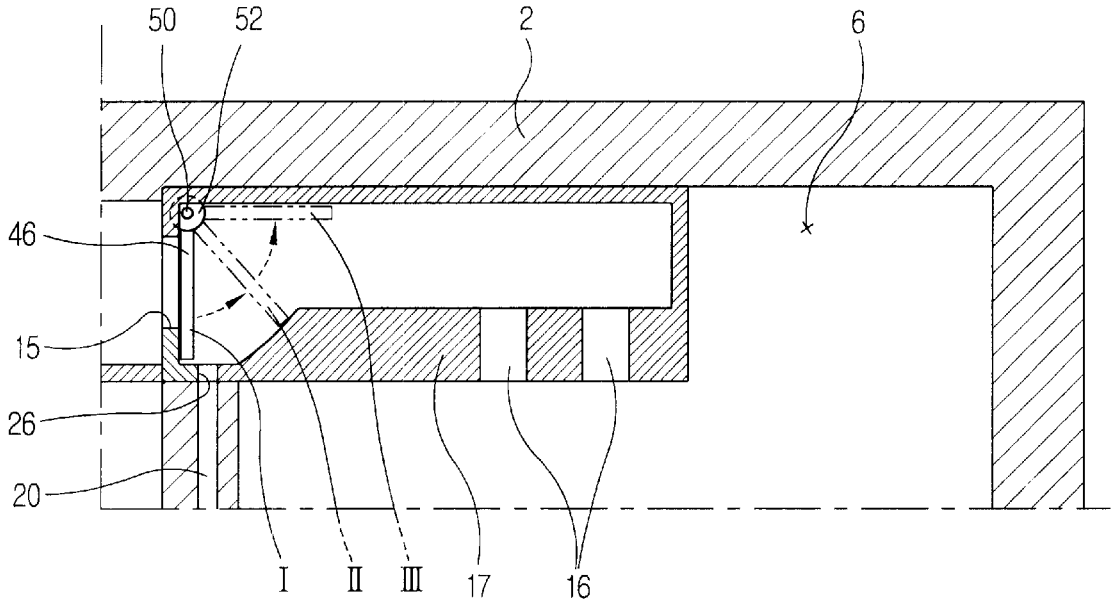
FIG. 6 is a sectional view illustrating an operation state of a damper of the refrigerator in accordance with the present invention.

As depicted in FIG. 6, the damper 46 rotationally installed on the upper surface of the cold air supply path 15 by a hinge shaft 50, and a damper driving unit 52 for providing a driving force to the damper 46 is installed at the hinge shaft 50.

Herein, the damper 46 has a disc shape, a certain side is connected to the hinge shaft 50, and it is preferable to use a stepping motor capable of adjusting a rotational angle as the damper driving unit 52.

By the operation of the damper driving unit 52, when the damper 46 is placed on a first position (I), cold air supply to the chilling chamber 6 is cut off, when the damper 46 is placed on a second position (II), cold air supply to the side cold air path 20 is open and cold air supply to the cold air discharge duct 17 is cut off, and when the damper 46 is placed on a third position (III), cold air supply to both the side cold air path 20 and the cold air discharge duct 17 is open.

And, a control unit 60 is included in order to control the damper driving unit 52 and the nozzle driving unit 40 according to a signal applied from the temperature sensor 36.

Figure 7:
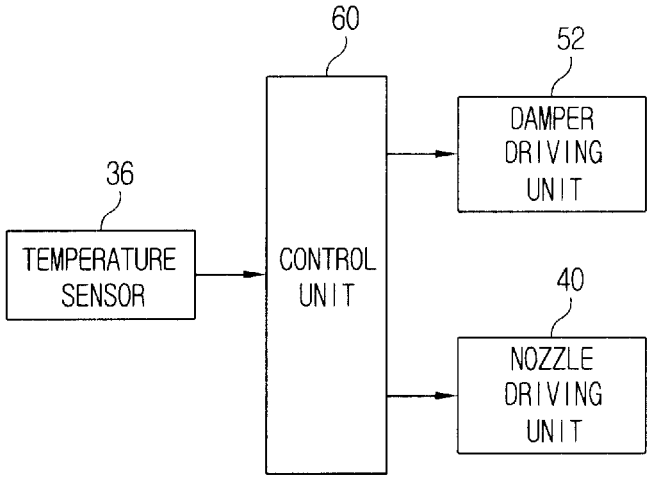
FIG. 7 is a block diagram illustrating a cold air supply control structure of the refrigerator in accordance with the present invention.

In more detail, as depicted in FIG. 7, the control unit 60 operates the damper driving unit 52 and the nozzle driving unit 40 according to a signal applied from the temperature sensor 36 installed on the front of the nozzle 34.

Hereinafter, the operation of the cold air supply apparatus of the refrigerator in accordance with the present invention will be described.

First, when the refrigerating cycle and the blower 12 are operated, air cooled while passing the refrigerating cycle is discharged into the freezing chamber 4 through the cold air discharge hole 13 formed at the panel 14 and performs the cooling operation by circulating the freezing chamber 4 and is supplied to the chilling chamber 6 through the cold air supply path 15 formed at the separation wall 8.

The cold air supplied to the cold air supply path 15 flows into the cold air discharge duct 17 and the side wall cold air path 20, is discharged into the chilling chamber 6 through the cold air discharge holes 16 formed on the cold air discharge duct 17 and performs the cooling operation. Herein, the damper 46 is placed at the third position (III), and accordingly the cold air supply is supplied to both the cold air discharge duct 17 and the side wall cold air path 20.

In the operation, when the nozzle driving unit 40 rotates, the nozzle 34 is rotated, and the temperature sensor 36 installed on the front of the nozzle 34 detects a temperature inside the chilling chamber 6. The control unit 60 judges whether a high-temperature load occurs according to the signal applied from the temperature sensor 36, when the high-temperature load occurrence is judged, it operates the damper driving unit 52, the damper 46 is moved to the second position (II), accordingly the side cold air path 20 is open and the cold air discharge duct 17 is closed.

Then, the cold air passing the cold air supply hole 15 is guided to the side wall of the chilling chamber 6 through the side cold air path 20 and is jet onto the high-temperature load occurred region through the cold air jet unit 10. Herein, when the nozzle driving unit 40 is operated by the control unit 60, the nozzle jet hole 32 of the nozzle 34 faces the high-temperature load occurred region.

Herein, in the intensive cooling operation through the cold air jet unit 10, because cold air supply to the cold air discharge duct 17 is cut off, a cold air jet pressure is not lowered, and accordingly it is possible to maintain a high pressure.

And, when a temperature inside the chilling chamber 6 falls below a set temperature, the damper 46 is operated at the first position (I), and accordingly cold air supply to the chilling chamber 6 is cut off.

Advantageous of the cold air supply apparatus of the refrigerator in accordance with the present invention will be described.

In the present invention, by connecting a side cold air path for guiding cold air to the side of a chilling chamber with a cold air discharge duct installed at the upper portion of the chilling chamber to discharge cold air inside the chilling chamber and installing a damper inside the cold air discharge duct, the damper is operated in three directions in order to pass/cut off cold air supply and perform cold air supply selectively to the side cold air path and the cold air discharge duct. And accordingly, it is possible to discharge cold air selectively from the side and the rear surface of the chilling chamber and prevent cold air discharge pressure lowering in an intensive cooling operation without using additional parts.

What is claimed is:

1. A cold air supply apparatus of a refrigerator, comprising:

a blower installed at the upper rear surface of a freezing chamber and forcibly ventilating air cooled while passing a refrigerating cycle;

a cold air discharge duct installed at the upper of a chilling chamber so as to communicate with a cold air supply path formed at the upper portion of a separation wall partitioning the freezing chamber and the chilling chamber and discharging cold air from the upper of the chilling chamber;

a side cold air path connected with a certain side of the cold air discharge duct, formed at the side wall of the chilling chamber and guiding cold air to the side of the chilling chamber; and a damper installed on a certain side of the cold air discharge duct in order to open/close the cold air supply hole, the side cold air path and both the side cold air path and the cold air discharge duct selectively.

2. The apparatus of claim 1, wherein the cold air discharge duct is installed on the upper portion of the chilling chamber so as to communicate with the cold air supply hole, a cold air discharge hole is respectively formed at the front and lower surfaces of the cold air discharge duct to discharge cold air inside the chilling chamber, and the side cold air path is connected to the bottom portion of the cold air discharge duct.

3. The apparatus of claim 1, wherein the damper is rotationally installed on the upper of the cold air discharge duct by a hinge shaft, and a damper driving unit for rotating the damper is connected to the hinge shaft.

4. The apparatus of claim 3, wherein the damper cuts off cold air supply to the chilling chamber by closing the cold air supply hole when it is placed on a first position according to the operation of the damper driving unit, cold air supply to the side cold air path is open and cold air supply to the cold air discharge duct is cut off when the damper is placed on a second position (II), and cold air supply to both the side cold air path and the cold air discharge duct is open when the damper is placed on a third position (III).

5. The apparatus of claim 3, wherein the damper driving unit is constructed as a stepping motor connected to the hinge shaft.

6. The apparatus of claim 1, further comprising:

a cold air jet unit installed at the end of the side cold air path to jet cold air onto a load occurred region inside the chilling chamber intensively; and a control unit for controlling the cold air jet unit and the damper according to a temperature inside the chilling chamber.

7. The apparatus of claim 6, wherein the cold air jet unit includes:

a housing fixed so as to communicate with the cold air discharge hole formed at the end of the side cold air path;

a nozzle rotatively supported by the housing and jetting cold air to a high-temperature load occurred region;

a temperature sensor installed on the front of the nozzle, rotating with the nozzle and sensing the high-temperature load occurred region inside the chilling chamber; and a nozzle driving unit for rotating the nozzle.

8. The apparatus of claim 7, wherein the control unit separately controls the operation of the nozzle driving unit and the damper driving unit according to a signal applied from the temperature sensor.

* * * * *